US008176634B2

(12) United States Patent
Bonner et al.

(10) Patent No.: US 8,176,634 B2
(45) Date of Patent: May 15, 2012

(54) METHOD OF MANUFACTURING A WELL SCREEN

(75) Inventors: Aaron J. Bonner, Flower Mound, TX (US); Jean-Marc Lopez, Plano, TX (US); Stephen M. Greci, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 93 days.

(21) Appl. No.: 12/166,966

(22) Filed: Jul. 2, 2008

(65) Prior Publication Data

US 2010/0000742 A1 Jan. 7, 2010

(51) Int. Cl.
*B23P 15/16* (2006.01)

(52) U.S. Cl. ..... 29/896.62; 29/6.1; 166/207; 166/227; 166/380

(58) Field of Classification Search ..... 29/896.62, 29/6.1, 33 D, 412, 415; 166/380, 384, 207, 166/227
See application file for complete search history.

(56) References Cited

U.S. PATENT DOCUMENTS 5,611,399 A 3/1997 Richard et al.
5,624,560 A 4/1997 Voll et al.
5,980,745 A 11/1999 Voll et al.
6,263,966 B1 7/2001 Haut et al.
6,305,468 B1 10/2001 Broome et al.
6,457,518 B1 10/2002 Castano-Mears et al.
6,478,092 B2 11/2002 Voll et al.
6,607,032 B2 8/2003 Voll et al.
7,077,196 B2 * 7/2006 Rudd ..... 166/207
7,497,257 B2 * 3/2009 Hopkins et al. ..... 166/278

OTHER PUBLICATIONS

Baker Hughes, Inc., "Excluder 2000™ Screen," 4 pages, dated Jun. 2000.
Baker Hughes, Inc., "EXPress Expandable Screen System," 4 pages, undated.
Halliburton, "PoroFlex® Expandable Completion System," 8 pages, undated.
Halliburton, "PoroFlex® Expandable Screen Completion Systems," 2 pages, dated Aug. 2006.
Halliburton, "Halliburton Screens," 6 pages, undated.

* cited by examiner

*Primary Examiner* — Richard Chang
(74) *Attorney, Agent, or Firm* — Marlin R. Smith

(57) ABSTRACT

An expanded non-bonded mesh well screen. A method of manufacturing a well screen includes the steps of: expanding at least a portion of a screen jacket; and then securing the screen jacket onto a base pipe. A well screen system includes a base pipe and an at least partially expanded screen jacket surrounding the base pipe. The screen jacket is expanded prior to being positioned on the base pipe.

10 Claims, 6 Drawing Sheets

METHOD OF MANUFACTURING A WELL SCREEN

BACKGROUND

The present disclosure relates generally to equipment utilized and operations performed in conjunction with a subterranean well and, in an embodiment described herein, more particularly provides an expanded non-bonded mesh well screen.

Well screens are typically used to exclude sand and formation fines from fluids produced from subterranean wells. Where wire mesh is used as a filter layer in a well screen, it has been found that bonding operations (such as welding and brazing) performed on the wire mesh are detrimental to the long-term usefulness of the wire mesh. For example, the wire mesh may be thus made more susceptible to erosion.

An attempt has been made to address the problems associated with a bonded wire mesh filter layer by swaging an entire screen jacket including the filter layer onto a base pipe. An overlap in a wrap of the wire mesh filter layer is used instead of welding to seal the filter layer against sand migration. However, this method of swaging the screen jacket also imparts undesirable stress concentrations in the filter layer, which can lead to premature failure.

Therefore, it will be appreciated that improvements are needed in the art of constructing well screens. These improvements may find use in well screens which either do or do not have wire mesh filter layers.

SUMMARY

In the present specification, systems and methods are provided which solve at least one problem in the art. One example is described below in which a screen jacket is expanded radially outward before being attached to a base pipe. Another example is described below in which sand migration through longitudinal ends of the screen jacket is prevented using crimps at the ends of the screen jacket.

In one aspect, a method of manufacturing a well screen is provided by this disclosure. The method includes the steps of: expanding at least a portion of a screen jacket; and then securing the screen jacket onto a base pipe. The expanding step may include expanding a filter layer of the screen jacket.

The screen jacket may include an outer shroud. The expanding step may include expanding the portion of the screen jacket outward into contact with the outer shroud. The expanding step may include expanding the outer shroud. The outer shroud may be unexpanded in the securing step.

The securing step may include crimping one or more ends of the screen jacket onto the base pipe. The crimping step may include preventing sand migration through a filter layer of the screen jacket at the one or more ends of the screen jacket. A substantial portion of the screen jacket between the one or more ends may remain uncrimped after the crimping step.

The securing step may include welding the screen jacket to the base pipe at the one or more ends of the screen jacket, and the welding step may include welding to the base pipe an unperforated end ring of at least one of an inner drainage layer and outer shroud of the screen jacket. The welding step may also, or alternatively, include welding to the base pipe a perforated end of at least one of the inner drainage layer and outer shroud of the screen jacket.

In another aspect, a well screen system is provided which includes a base pipe and an at least partially expanded screen jacket surrounding the base pipe. The screen jacket is expanded prior to being positioned on the base pipe.

The described examples provide a well screen system which is: 1) radially compact, 2) free of undesirable stress and strain concentrations in its filter layer(s), 3) resistant to erosion, 4) free of welding and brazing in its filtering portion, 5) convenient and economical to manufacture, 6) mechanically strengthened, and 7) which has enhanced sand filtering capabilities.

These and other features, advantages, benefits and objects will become apparent to one of ordinary skill in the art upon careful consideration of the detailed description of representative embodiments hereinbelow and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings.

Figure 1:
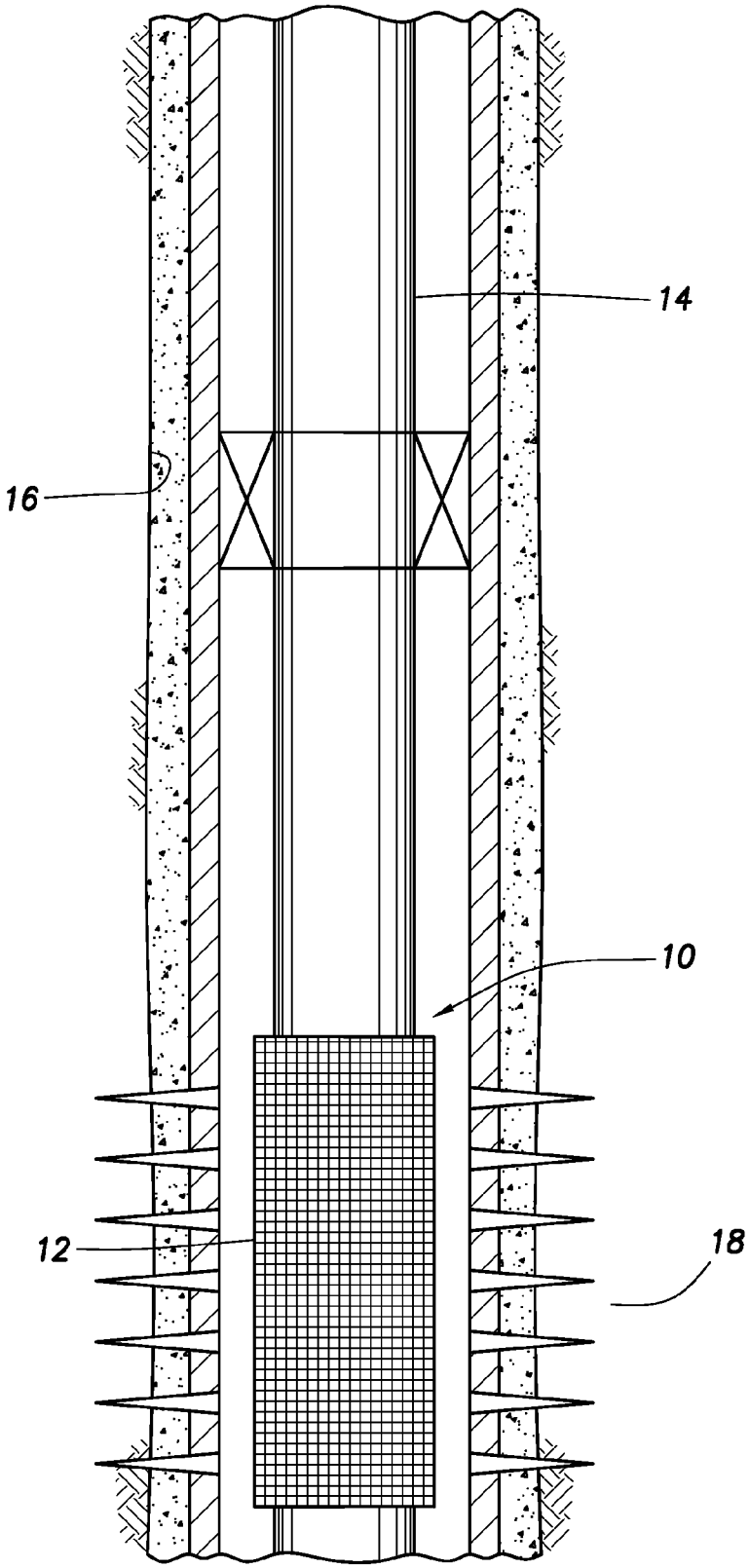
FIG. 1 is a schematic partially cross-sectional view of a well system embodying principles of the present disclosure.

Representatively illustrated in FIG. 1 is a well screen system 10 which embodies principles of the present disclosure. As depicted in FIG. 1, a well screen 12 has been interconnected in a tubular string 14 (such as a liner string or a production tubing string) and positioned in a wellbore 16. The well screen 12 filters sand and formation fines out of fluid flowing from a formation 18 into the tubular string 14.

The well screen system 10 and methods of manufacturing the well screen 12 as described below provide many advancements in the art. However, it should be clearly understood that the principles of this disclosure are not limited in any way to the details illustrated in FIG. 1. For example, the wellbore 16 could be uncased or open hole, the screen 12 could be gravel packed, etc.

Figure 2:
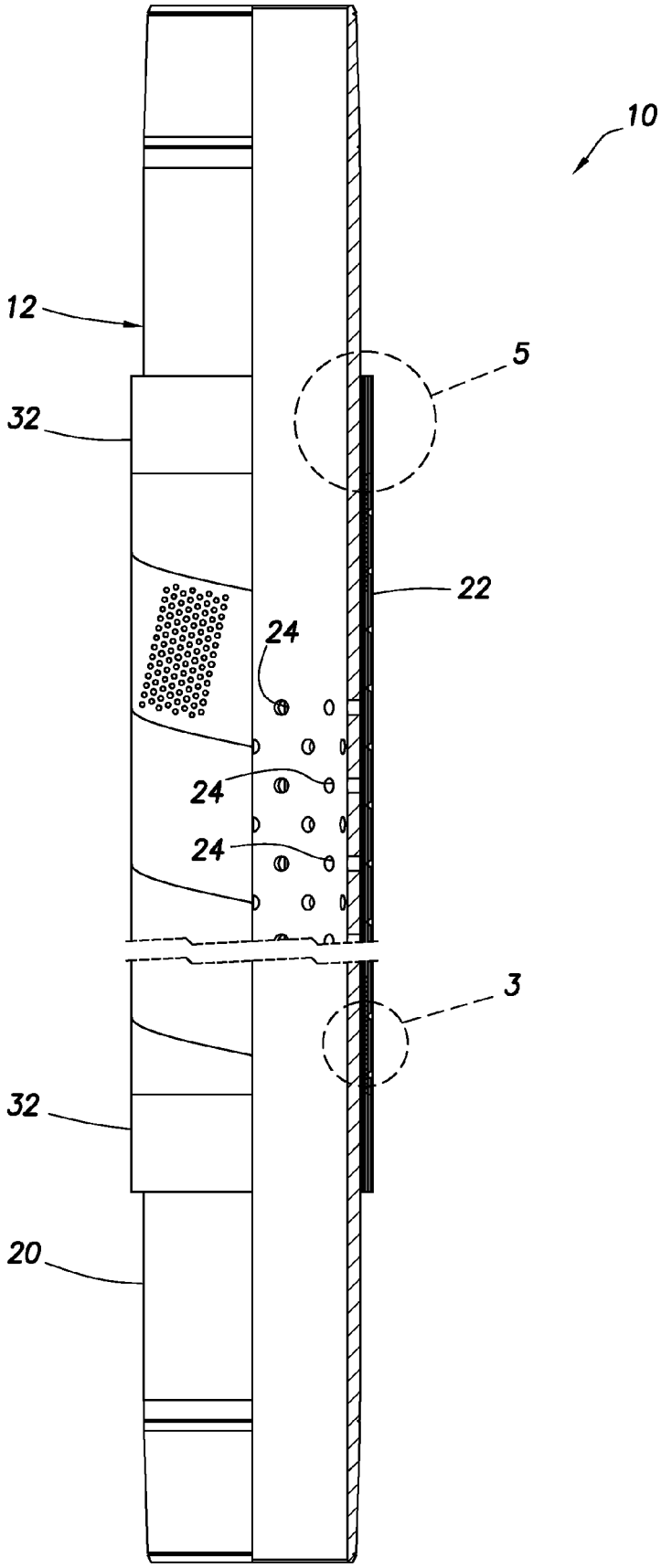
FIG. 2 is an enlarged scale cross-sectional view through a well screen system usable in the well system of FIG. 1.

Referring additionally now to FIG. 2, an enlarged detailed view of the well screen 12 is representatively illustrated. In this view, the construction of the well screen 12 may be conveniently seen.

The screen 12 includes a perforated base pipe 20. Opposite longitudinal ends of the base pipe 20 are preferably provided with threads for interconnecting the well screen 12 in the tubular string 14, but other connection means may be used, if desired.

Surrounding the base pipe 20 is a screen jacket 22. The jacket 22 is used to filter the fluid flowing from the exterior to the interior of the screen 12. Preferably, the jacket 22 includes multiple layers of material, examples of which are depicted in FIGS. 3-4F and described below.

In one unique feature of the screen 12, the jacket 22 is expanded radially outward prior to being positioned on the base pipe 20. After positioning the jacket 22 appropriately overlying perforations 24 through the base pipe 20, the opposite longitudinal ends of the jacket 22 are crimped onto the base pipe, and then the ends of the jacket are welded to the base pipe. This process is described more fully below.

Figure 3:
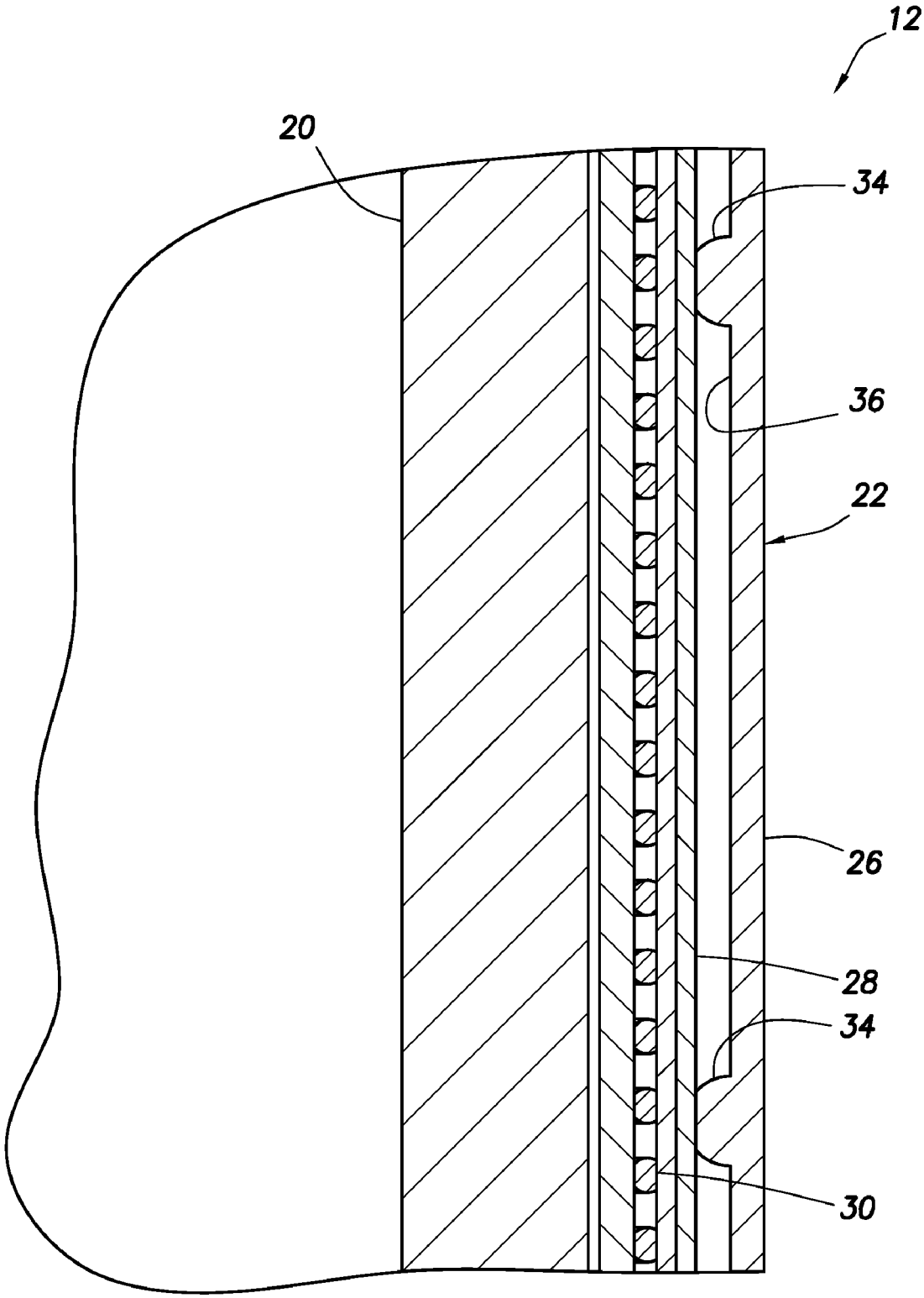
FIG. 3 is a further enlarged scale cross-sectional view of a screen jacket and base pipe of the well screen system.

Referring additionally now to FIG. 3, an enlarged scale cross-sectional view of a portion of the well screen 12 is representatively illustrated. In this view, the various layers making up the screen jacket 22, and their relationship to the base pipe 20 may be more clearly seen.

In the example of FIG. 3, the screen jacket 22 includes an outer shroud 26, a wire mesh filter layer 28 and an inner wire wrap drainage layer 30. Each of these layers performs at least one specific important function in the jacket 22, but it should be clearly understood that the principles of this disclosure are not limited to use of any particular layer or combination of layers in a screen jacket.

The outer shroud 26 serves to protect the screen jacket 22 during installation of the well screen 12, during operations such as gravel packing, etc. Preferably, the outer shroud 26 is made of a helically wrapped perforated stainless steel material, which is provided with unperforated tubular end rings 32 at its opposite ends (see FIG. 5A).

The filter layer 28 serves as the filtering element which excludes sand, formation fines, etc. from passing through the screen jacket 22. Preferably, the filter layer 28 is made of a relatively fine stainless steel wire mesh or woven wire.

The drainage layer 30 serves as an interface between the filter layer 28 and the base pipe 20, providing flow paths for fluid exiting the filter layer to flow into the perforations 24 of the base pipe, and providing outward support for the filter layer. Preferably, the drainage layer 30 is made of stainless steel wire closely wrapped helically about multiple longitudinally extending stainless steel stays or rods.

Note that, in this example, the outer shroud 26 has multiple inwardly extending dimples or protrusions 34 on its inner surface 36. These protrusions 34 provide radial space about the filter layer 28, so that the fluid can readily flow between the perforated portions of the outer shroud 26 and the outer surface of the filter layer.

In addition, note that the filter layer 28 appears in FIG. 3 to be made up of multiple layers. This is due to the fact that there is an overlap between circumferential ends of the filter layer 28 in the area depicted in FIG. 3.

When constructing the screen jacket 22, an initially flat rectangle of the filter layer 28 is rolled into a tubular shape, with an overlap between its circumferential ends. This overlap serves to prevent migration of sand or other debris through the filter layer 28, without requiring the circumferential ends to be welded or brazed together.

Note, also, that the screen jacket 22 has a relatively small radial thickness, with the filter layer 28 in intimate contact with the protrusions 34 on the inner surface 36 of the outer shroud 26, with intimate contact between the filter layer and the drainage layer 30, and with minimal radial clearance between the screen jacket and the base pipe 20. These desirable features are achieved as a result of the unique construction process described below, in which the filter and drainage layers 28, 30 are expanded within the outer shroud 26 prior to positioning the screen jacket 22 on the base pipe 20.

Referring additionally now to FIGS. 4A-F, various different constructions of the screen jacket 22 are representatively illustrated. These additional examples of the screen jacket 22 construction demonstrate that the principles of this disclosure are not limited to any one type of jacket construction.

Figure 4A:
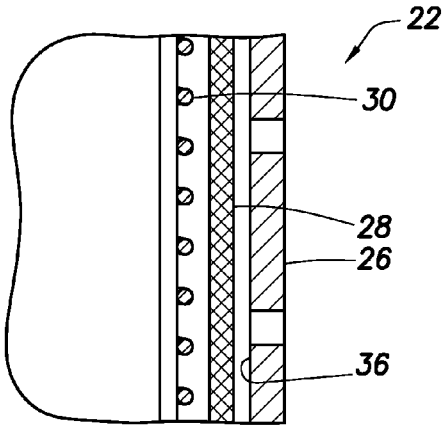
FIGS. 4A-F are schematic cross-sectional views of additional screen jacket constructions which may be used in the well screen system.

In FIG. 4A, the jacket 22 is very similar to the construction of FIG. 3, except that there are no protrusions 34 on the inner surface 36 of the outer shroud 26. The various jacket 22 constructions described in this disclosure may or not be provided with the protrusions 34, as desired.

Figure 4B:
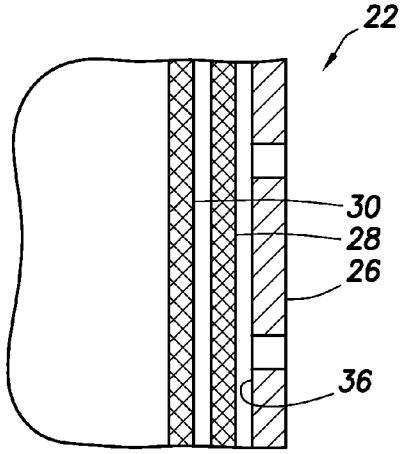
Figure 4C:
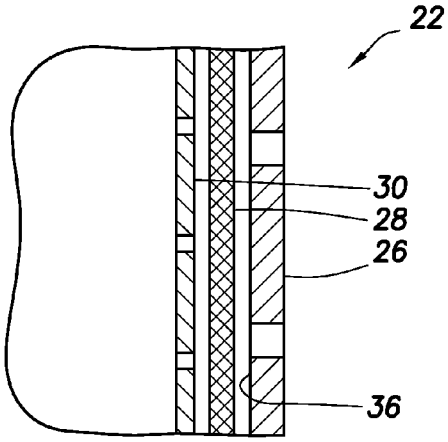
Figure 4D:
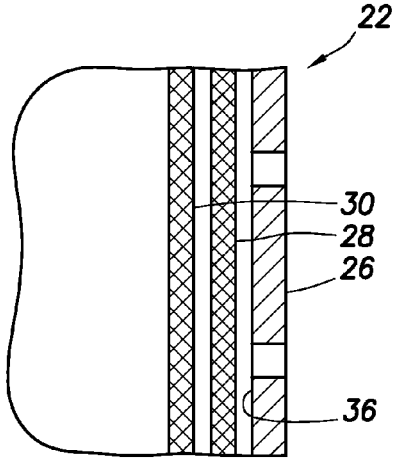

In FIG. 4B, the drainage layer 30 is preferably made of a relatively coarse stainless steel welded wire mesh. In FIG. 4C, the drainage layer 30 is preferably made of a perforated stainless steel tube, which may be similar in construction to the outer shroud 26 (e.g., helically formed and/or with unperforated end rings at each longitudinal end, etc.). In FIG. 4D, the screen jacket 22 is very similar to the construction of FIG. 4B, except that the drainage layer 30 is preferably made of a relatively coarse stainless steel pre-crimped wire mesh, which is not necessarily welded. These examples demonstrate that various types of drainage layers may be used in keeping with the principles of this disclosure.

Figure 4E:
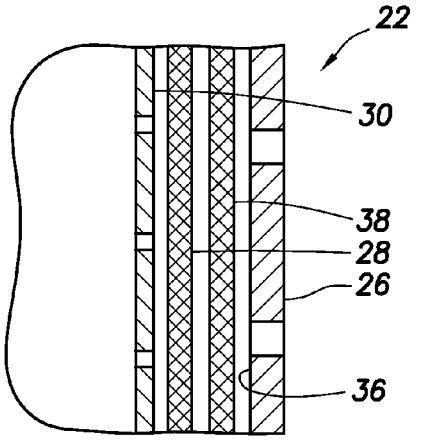
Figure 4F:
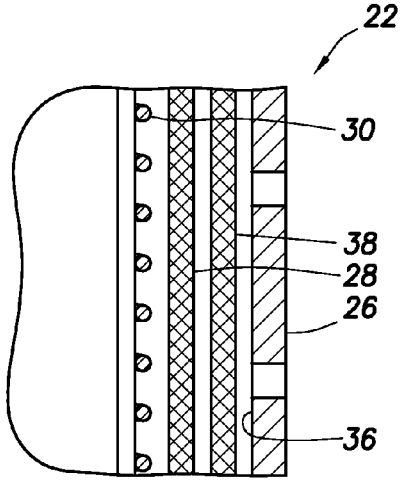

In FIG. 4E, two filter layers 28, 38 are used, with the outer filter layer 38 preferably being made of a relatively coarse stainless steel unwelded wire mesh or woven wire, and with the inner filter layer 28 preferably being made of a relatively fine stainless steel unwelded wire mesh or woven wire. The screen jacket 22 of FIG. 4F is similar to the construction of FIG. 4E, except that the drainage layer 30 is preferably made of a wire wrap instead of a perforated tube. These examples demonstrate that any number and combination of the layers may be used in keeping with the principles of this disclosure.

Note that in FIGS. 4A-F there appears to be radial space between each of the layers in the screen jacket 22. These radial spaces may exist prior to expanding the jacket 22, but preferably after the expansion process there is no radial space between the layers, thus providing for a radially compact construction.

Figure 5B:
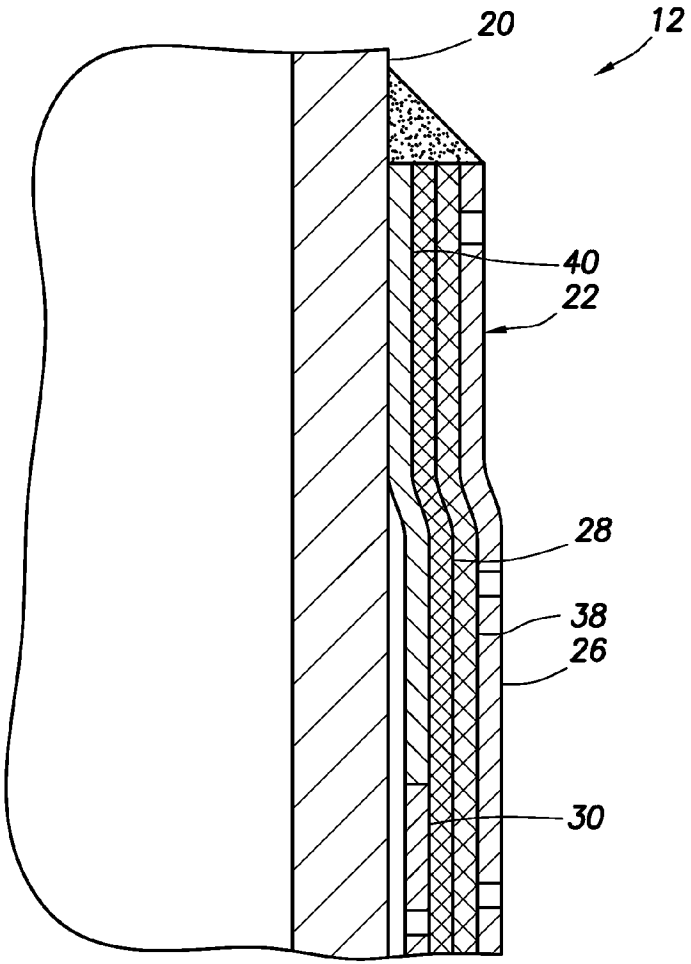
FIGS. 5A&B are schematic cross-sectional views of techniques for securing the screen jacket to the base pipe.
Figure 5A:
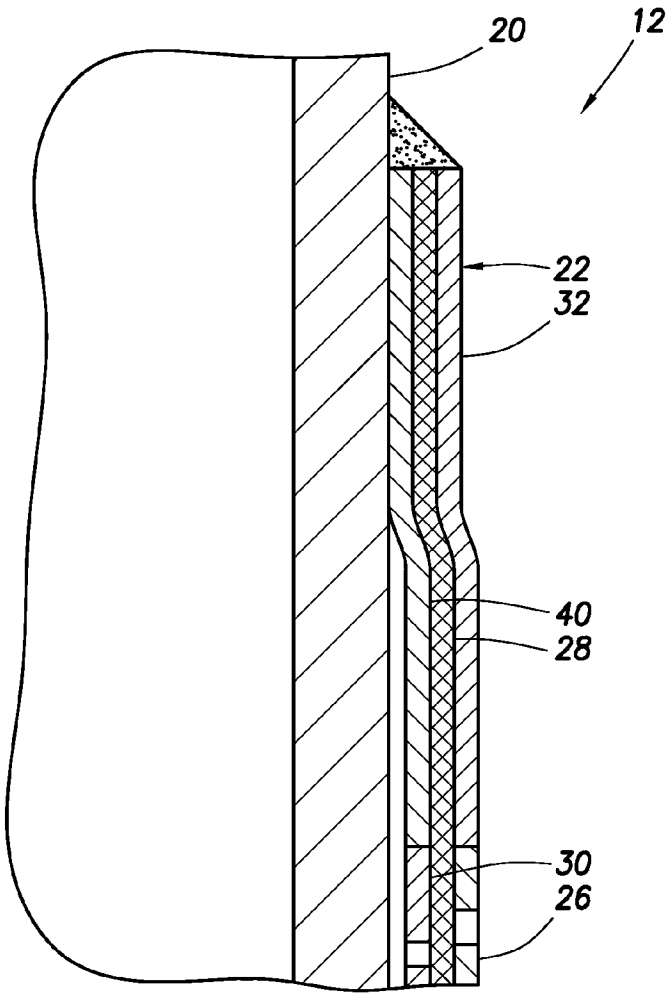

Referring additionally now to FIGS. 5A&B, examples of techniques for securing the screen jacket 22 to the base pipe 20 are representatively illustrated. In each of these, the opposite longitudinal ends of the jacket 22 are crimped radially inwardly onto the base pipe 20, and then the ends of the jacket are welded to the base pipe, but it should be clearly understood that other techniques for securing the jacket to the base pipe may be used as desired.

In FIG. 5A, the screen jacket 22 is similar to that depicted in FIG. 4C. The drainage layer 30 has a tubular unperforated end ring 40 at each of its opposite longitudinal ends, similar to the end rings 32 on the outer shroud 26. When the jacket 22 is welded to the base pipe 20, the end rings 32, 40 and the filter layer 28 are the specific elements which are welded to the base pipe.

In FIG. 5B, the outer shroud 26 is not provided with the end rings 32, and the jacket 22 is similar to that depicted in FIG. 4E. This example demonstrates that the end rings 32, 40 are not necessarily provided in the screen jacket 22, and that any configuration of the jacket may be used in keeping with the principles of this disclosure.

Note that it is not necessary to weld the screen jacket 22 to the base pipe 20 if the crimping operations are properly performed. The crimping operation preferably seals the ends of the screen jacket 22 against sand migration and secures the jacket to the base pipe 20, so that welding is not strictly necessary. For example, it will be appreciated that in the configuration of FIG. 5A, the crimping of the filter layer 28 between the outer shroud 26 and drainage layer 30 prevents migration of sand or other debris longitudinally between the layers, without the need for welding.

Figure 6:
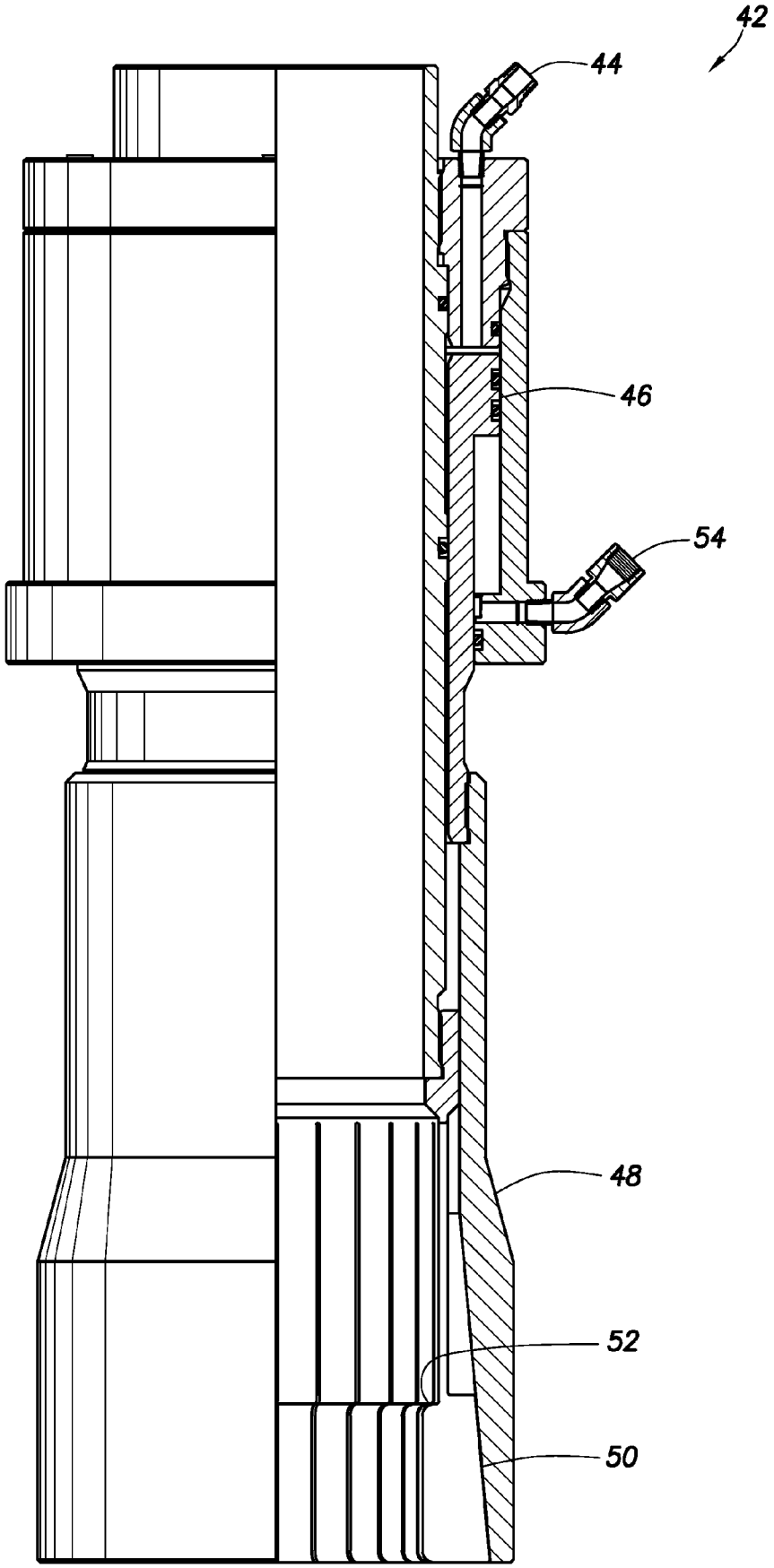
FIG. 6 is a partially cross-sectional view of a crimping tool usable in the securing techniques of FIGS. 5A&B.

Preferably, the crimping operation is performed without inducing substantially increased levels of stress and strain in the layers of the screen jacket 22, and particularly so in the filter layer 28. In FIG. 6, a crimping tool 42 which may be used to satisfactorily perform the crimping operation is representatively illustrated.

The crimping tool 42 is positioned on the ends of the screen jacket 22 in succession after the jacket is appropriately positioned on the base pipe 20. Pressure applied via a connector 44 biases a piston 46 downward as viewed in FIG. 6, thereby downwardly displacing an internally tapered collet housing 48.

This downward displacement of the collet housing 48 causes segmented collets 50 to displace radially inward. With the collets 50 positioned radially outward of the end of the screen jacket 22, this inward displacement of the collets will cause the end of the screen jacket to be crimped radially inward.

Shoulders 52 on the collets 50 are radiused to prevent causing significant stress concentrations in the area between the crimped and uncrimped portions of the jacket 22 ends. Pressure may then be applied via another connector 54 to upwardly displace the piston 46 and collet housing 48, thereby allowing the collets 50 to spring back radially outward.

In a preferred method of constructing the well screen 12, the following steps are performed in the listed order:

1) The filter layer 28 (e.g., a wire mesh) is conditioned by rolling it into a tubular shape.

2) Circumferential ends of the filter layer 28 are overlapped.

3) The filter layer 28 is installed into the interior of the outer shroud 26.

4) The drainage layer 30 is installed into the interior of the filter layer.

5) The drainage layer 30 and filter layer 28 are expanded radially outward at least until the filter layer contacts the inner surface 36 of the outer shroud 26, and all of the layers are in intimate contact with their adjacent layer(s). Further expansion can be used to radially outwardly expand the outer shroud 26, if desired, which may be useful to "size" the outer shroud, for example, to compensate for manufacturing tolerances. The expansion process may be accomplished by drawing, pushing or otherwise forcing a conical drift or mandrel through the interior of the drainage layer 30, by pressurizing an inflatable bladder or membrane within the jacket 22, or by any other expansion technique. Before the expansion step, the jacket 22 has an interior dimension (e.g., an ID) less than an exterior dimension (e.g., an OD) of the base pipe 20, but after the expansion step, the jacket interior dimension is equal to or greater than the exterior dimension of the base pipe.

6) The expanded screen jacket 22 is positioned on the base pipe 20.

7) The ends of the screen jacket 22 are crimped onto the base pipe 20.

8) The ends of the screen jacket 22 are welded to the base pipe 20.

It may now be fully appreciated that the above disclosure provides many advancements to the art of constructing well screens. In particular, the described examples provide a well screen system 10 which is radially compact, free of undesirable stress and strain concentrations in its filter layer(s), resistant to erosion, free of welding and brazing in its filtering portion, convenient and economical to manufacture, mechanically strengthened, and which has enhanced sand filtering capabilities.

The above disclosure provides a method of manufacturing a well screen 12 which includes the steps of: expanding at least a portion of a screen jacket 22; and then securing the screen jacket 22 onto a base pipe 20. The expanding step may include expanding a filter layer 28 of the screen jacket 22.

The screen jacket 22 may include an outer shroud 26. The expanding step may include expanding the portion of the screen jacket 22 outward into contact with the outer shroud 26. The expanding step may include expanding the outer shroud 26. The outer shroud 26 may be unexpanded in the securing step.

The securing step may include crimping one or more ends of the screen jacket 22 onto the base pipe 20. The crimping step may include preventing sand migration through a filter layer 28 of the screen jacket 22 at the one or more ends of the screen jacket. A substantial portion of the screen jacket 22 between the one or more ends may remain uncrimped after the crimping step.

The securing step may include welding the screen jacket 22 to the base pipe 20 at the one or more ends of the screen jacket, and the welding step may include welding to the base pipe 20 an unperforated end ring 32, 40 of at least one of an inner drainage layer 30 and outer shroud 26 of the screen jacket 22. The welding step may also, or alternatively, include welding to the base pipe 20 a perforated end of at least one of the inner drainage layer 30 and outer shroud 26 of the screen jacket 22.

Also provided is the well screen system 10 which includes a base pipe 20 and an at least partially expanded screen jacket 22 surrounding the base pipe. The screen jacket 22 is expanded prior to being positioned on the base pipe 20.

The base pipe 20 may be unexpanded when the expanded screen jacket 22 is positioned on the base pipe.

At least one end of the screen jacket 22 is crimped onto the base pipe 20. A substantial portion of the screen jacket 22 may be uncrimped. A crimp at an end of the screen jacket 22 may exclude sand from migrating through a filter layer 28 of the screen jacket at the crimp. An outer shroud 26 of the screen jacket 26 may be perforated at the crimped end of the screen jacket.

The filter layer 28 may contact the outer shroud 26 due to expansion of the screen jacket 22. The outer shroud 26 may be expanded or unexpanded when the screen jacket 22 is positioned on the base pipe 20.

The screen jacket 22 may not be welded to the base pipe 20 during sand-screening use of the well screen system 10.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of manufacturing a well screen, the method comprising the steps of:

forming a screen jacket comprising an outer shroud and a one-piece generally cylindrical filter layer having an overlap between circumferential ends of the filter layer;

radially expanding the filter layer within the outer shroud, thereby preventing sand migration between the overlapping circumferential ends; and then securing the screen jacket onto a base pipe.

2. The method of claim 1, wherein the screen jacket comprises multiple filter layers, and wherein the expanding step further comprises expanding the multiple filter layers of the screen jacket.

3. The method of claim 1, wherein the screen jacket comprises a drainage layer, and wherein the expanding step further comprises expanding the drainage layer with the filter layer being positioned between the drainage layer and the outer shroud.

4. The method of claim 1, wherein the expanding step further comprises expanding the outer shroud.

5. The method of claim 1, wherein the securing step further comprises crimping at least one end of the screen jacket onto the base pipe.

6. The method of claim 5, wherein the crimping step further comprises preventing sand migration through the filter layer at the end of the screen jacket.

7. The method of claim 5, wherein a substantial portion of the screen jacket remains uncrimped after the crimping step.

8. The method of claim 1, wherein the securing step further comprises welding at least one end of the screen jacket to the base pipe, and wherein the welding step further comprises welding to the base pipe an unperforated end ring of at least one of an inner drainage layer and the outer shroud of the screen jacket.

9. The method of claim 1, wherein the securing step further comprises welding at least one end of the screen jacket to the base pipe, and wherein the welding step further comprises welding to the base pipe a perforated end of at least one of an inner drainage layer and the outer shroud of the screen jacket.

10. The method of claim 1, wherein the outer shroud is unexpanded in the expanding step.

* * * * *